United States Patent [19]

Hass

[11] Patent Number: 4,964,643

[45] Date of Patent: Oct. 23, 1990

[54] FOLDABLE GAME BOARD AND METHOD OF MAKING THE SAME

[76] Inventor: David L. Hass, 5629 W. Keefe Ave., Apt. 4, Milwaukee, Wis. 53216

[21] Appl. No.: 388,861

[22] Filed: Aug. 3, 1989

[51] Int. Cl.[5] ..... A63F 3/00; A63H 33/16

[52] U.S. Cl. ..... 273/285; 446/488

[58] Field of Search ..... 273/285, 286; 40/539; 493/405, 374, 382; 281/49, 47, 23, 51; 283/34, 35; 229/92, 92.1; 206/315.1; 446/488

[56] References Cited

U.S. PATENT DOCUMENTS

| | | | |
|---|---|---|---|
| 52,891 | 2/1866 | Schaefer | 273/285 |
| 734,092 | 7/1903 | Reed | 273/285 |
| 847,545 | 3/1907 | Braine | 273/155 |
| 1,024,194 | 4/1912 | Frank | 273/285 |
| 1,336,954 | 4/1920 | Gillies | 273/285 |
| 2,147,900 | 2/1939 | Houseknecht | 273/285 |
| 2,729,451 | 1/1956 | Larson | 273/285 |
| 3,654,375 | 4/1972 | Geiger | 446/488 |
| 3,836,418 | 9/1974 | Montgomery | 161/17 |
| 4,627,640 | 12/1986 | Markovics | 283/34 |

OTHER PUBLICATIONS

Fun with Paper Folding by William D. Murray and Francis J. Rigney, Fleming H. Revell Co., 1953, pp. 24–30.

*Primary Examiner*—Benjamin Layno
*Attorney, Agent, or Firm*—L. G. Vande Zande

[57] ABSTRACT

A planar surface game board is divided into orthogonal quadrants and subdivided diagonally. The quadrants are hinged together along contiguous edges at a first surface and the diagonal subdivision is hinged together at a second surface, permitting the board to be folded or collapsed inwardly of the first surface wherein diagonally divided segments collapse adjacent each other between square quadrant segments to form a folded board one-fourth its original surface size and four times its thickness. The hinges may be formed by scoring the respective surfaces without completely severing the board, leaving thin webs of material as hinges.

16 Claims, 2 Drawing Sheets

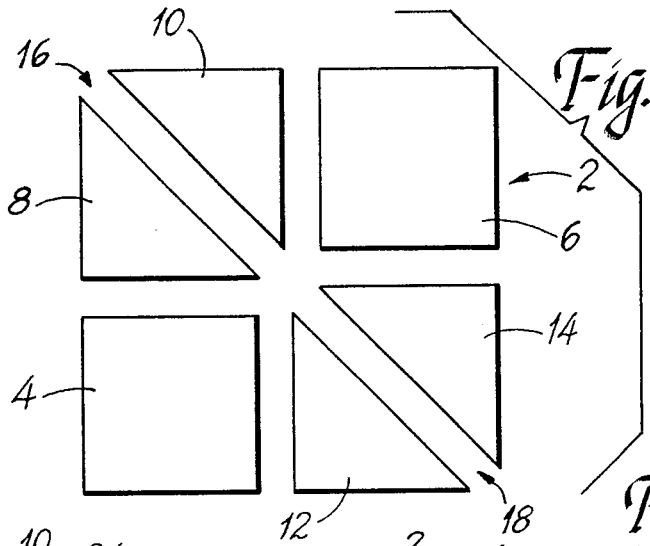
Fig. 1
Fig. 2
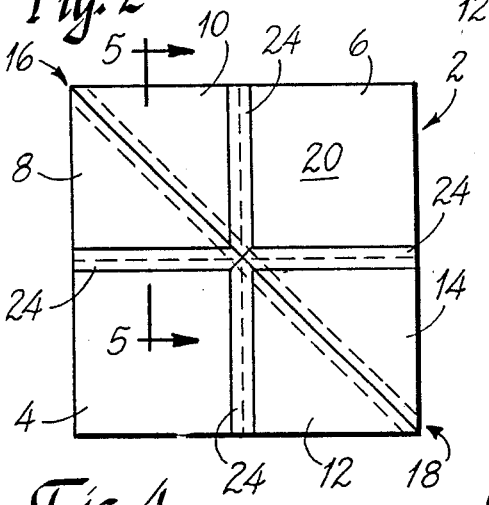
Fig. 3
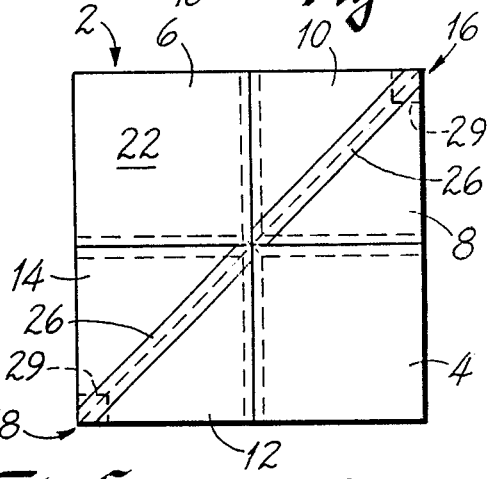
Fig. 4
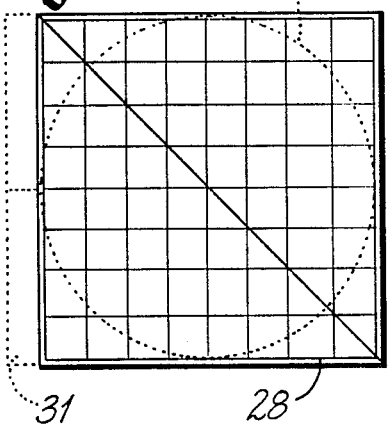
Fig. 5
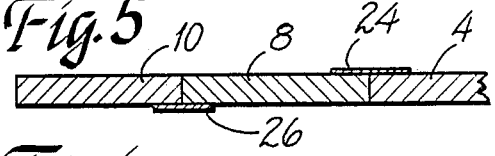
Fig. 6
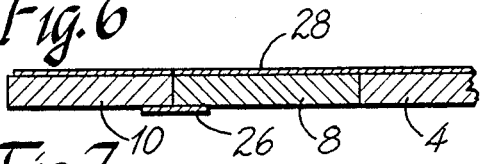
Fig. 7
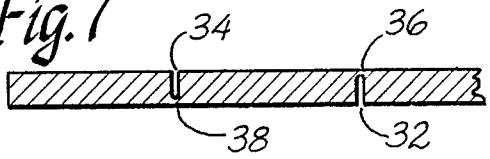

FOLDABLE GAME BOARD AND METHOD OF MAKING THE SAME

BACKGROUND OF THE INVENTION

This invention relates to planar surface boards hinged to fold to a size less than the original surface area of the board. More particularly, this invention relates to a board of the aforementioned type which is foldable to a size one-fourth the original surface area of the board. The invention has particular utility in game boards and portable table surfaces.

Conventional game boards have a planar surface and customarily a square outline shape. Such boards comprise two identical rectangular segments hinged at the playing surface along contiguous edges to form the square outline when opened flat and foldable to the size of one of the rectangles which is one-half the open size. Boxes in which the game board and separate game pieces are marketed and stored are rectangular to accommodate the folded board. Boxes so constructed often contain substantial empty space, are structurally weak, and require much space for storing, particularly on or in conventional size shelves or cabinets of residential living units.

SUMMARY OF THE INVENTION

This invention provides a planar surface board which is foldable to a size one-fourth its open surface by four times its thickness by providing hinges along orthogonal center lines at a first surface and along a diagonal at a second surface. In a preferred embodiment, the board has a square outline, although a circular outline and other outline shapes are also contemplated.

The foldable board constructed according to this invention has a substantially uniform thickness no greater than one-eighth the length of a side of the square outline, or of a square circumscribed around a circular outline. It comprises segments constituting quadrants derived by dividing the board along orthogonal center lines. Two diagonally opposed quadrant segments are further divided into triangular subsegments along a diagonal extending through both of the subdivided segments and the orthogonal center of the board. The triangular subsegments are hinged at the second surface of the board along the respective hypotenuses thereof to reestablish the quadrant segments. The four quadrant segments are hinged at the first surface of the board along respective contiguous edges. The board is folded from an open flat position in which the first surface faces upward by raising the opposite corners at the diagonal, bringing those corners together and then folding the raised portion downward upon one quadrant segment along hinges formed at respective contiguous quadrant edges. The flexible board constructed in the aforedescribed manner may be contained in a square box with less empty space than in conventional game board boxes. The square-shaped box is structurally stronger and is more readily storable, both at the marketplace and at the residence of the consumer. The foldable board, its features and advantages will become more apparent when reading the following description and claims in conjunction with the accompanying drawings.

BRIEF DESCRIPTION OF THE DRAWINGS

FIG. 1 is an exploded plan view of individual segments that comprise the foldable plane surface board of this invention;

FIG. 2 is a plan view of the foldable plane surface board of this invention showing hinges at a first surface of the board;

FIG. 3 is a plan view of the foldable plane surface board of this invention showing hinges at a second surface of the board, which second surface is opposite the first surface;

FIG. 4 is a plan view of the board constructed as in FIGS. 2 and 3 showing a graphic pattern on one surface, and an alternate circular outline of the board in phantom line;

FIG. 5 is a cross sectional view taken along line 5—5 in FIG. 2, drawn to an enlarged scale;

FIG. 6 is a cross sectional view similar to FIG. 5 showing an alternate embodiment of hinge along the first surface;

FIG. 7 is a cross sectional view similar to FIG. 5 showing a second alternate embodiment of hinge along both surfaces;

DESCRIPTION OF THE PREFERRED EMBODIMENT

Figure 8:
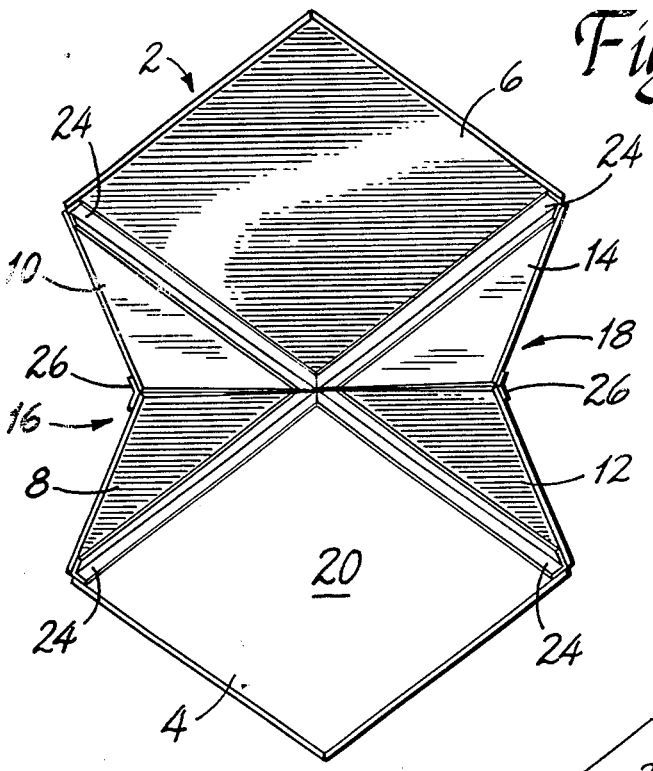
FIG. 8 is a perspective view of the board of this invention, showing the board in an intermediate folded state.

As will be explained later herein, the foldable planar surface board 2 of this invention may be made of a single element, but for clarity it will be initially described as constituting individual segments as shown in FIG. 1. Two segments 4 and 6 are squares, each one-fourth or a quadrant of the final assembled board 2. Four identical right triangular segments 8, 10, 12 and 14 are arranged in pairs with respective hypotenuses coextensively arranged to form square segments 16 and 18 identical to segments 4 and 6. The square segments 4, 6, 16 and 18 are arranged in an orthogonal quadrant relationship as shown with segments 16 and 18 disposed diagonally opposite and the diagonal formed by the coextensive hypotenuses aligned through the center of the board.

The individual segments are joined together in the manner described hereinafter, preferably by thin flexible strips affixed to a respective first surface 20 of the board (FIG. 2) and to a respective second surface 22 of the board (FIG. 3). Four such strips 24 are affixed along contiguous edges of segments 4, 6, 16 and 18 on first surface 20, the strips 24 spanning the respective joints of the contiguous edges. The strips may be affixed by a mastic, or may be adhesive backed. Thin strips are preferred because the axis of the hinge automatically lies in the plane of the first surface 20. Other forms of hinges may be used, provided the axis thereof lies in the surface plane. As can be seen in FIG. 2, the ends of strips 24 that meet at the orthogonal center of board 2 are mitered to form a non-overlapping joint.

The segments hinged together as described above form two large right triangles divided along the hypotenuses of segments 16 and 18. With the board inverted and second surface 22 facing upward, the two larger right triangles are joined by affixing thin flexible strips 26 along the respective coextensive hypotenuses of triangular segments 8 and 10, 12 and 14 at the second surface 22 of board 2. The strips 26 may be a single continuous strip, but are preferably separate strips, closely adjacent at their inner ends. In this position, with the segments constructed of a thickness approximately one-sixteenth the length of a square segment, or greater, the board will sustain its planar shape when supported on the first surface 20 at the opposite diagonal corners in the areas designated 29 in FIG. 3.

Figure 10:
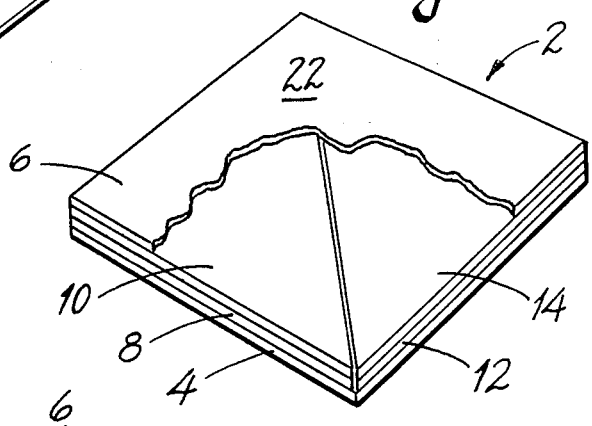
FIG. 10 is a perspective view of the board of this invention in a final folded state.
Figure 9:
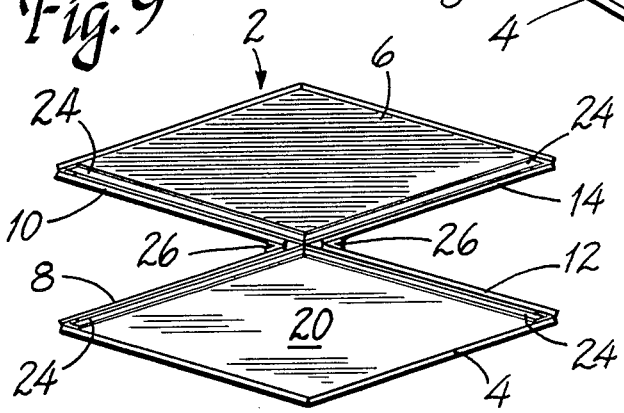
FIG. 9 is a perspective view of the board of this invention, showing the board in a further sequential folded state from that shown in FIG. 8.

Board 2, hingedly joined as aforedescribed, is foldable by placing it open, flat on its second surface 22 with first surface 20 facing up as in FIG. 2. The outer corners at the diagonal formed by the respective coextensive hypotenuses are raised as shown in FIG. 8, causing triangular segments 8 and 10, 12 and 14 to collapse inwardly. This action causes square segments 4 and 6 to also collapse inwardly, pivoting along the respective contiguous edges joined by hinge strips 24. FIG. 9 shows the board further collapsed by continued bringing together of the corners of the diagonal, the hypotenuses of triangular segments 8 and 10 closely approaching the hypotenuses of triangular segments 12 and 14. The fully folded board 2 is shown in FIG. 10. Part of segment 6 is broken away to illustrate that the respective hypotenuses lie closely adjacent, flat along the segments 4 and 6. The folded board has a surface area size of one-fourth the original open surface, and four times the thickness of the board.

FIG. 5 shows the hinge strips 24 and 26 applied to surfaces 20 and 22, respectively. Alternatively, hinge strips 24 may be substituted for by a continuous sheet 28 covering substantially the entire first surface of board 2 to provide a smooth surface as shown in FIG. 4. In this version the sheet 28 is severed along the diagonal formed by the respective hypotenuses of triangular segments 8 and 10, 12 and 14. A cross section showing the hinge arrangement of FIG. 4 is shown in FIG. 6.

When used as a game board, or a collapsible or foldable display form, the first and/or second surface 20 and/or 22 may be imprinted with a graphic pattern as also illustrated in FIG. 4. This pattern may preferably be imprinted on the sheet 28 which is affixed to the surface 20.

The board may also be constructed in a circular outline as also illustrated in FIG. 4 by the phantom line 30. The division of the circular board is also made along the orthogonal center lines as in the square outline board 2, and along a diagonal. Furthermore, the board may have a rectangular outline in its open condition by extending one edge beyond the inscribed square such as shown by the dotted line 31 along the left-hand edge in FIG. 3. This version of the board is folded along the original square with the surface of the extension defined by line 31 extending beyond the edge of the folded board. The opposite (right-hand) edge of the board may also be extended to increase the length of the rectangle; that extension extending beyond the lower edge in the folded form, again creating a square in folded form, but with a corner cut out.

Still another embodiment of the board of this invention is illustrated in FIG. 7. The board is formed of a single sheet and divided into the orthogonal quadrants aforedescribed by scoring the second surface to approximately the full thickness of the board, but not completely therethrough as shown at 32 in FIG. 7. A diagonal score is formed on the first surface of the board to approximately the full thickness, but not completely therethrough as shown at 34. The scores form thin web hinges 36 and 38, respectively, to permit the board to be folded as aforedescribed.

Although the foldable planar surface board of this invention has been described herein in a preferred embodiment and particularly described alternate embodiments, it is to be understood that the invention is not limited to the described embodiments and is susceptible of various modifications without departing from the scope of the appended claims.

I claim:

1. A game board having a planar square shape and a substantially uniform thickness defining a planar game-playing surface in an open condition of said board foldable to a square storage condition having a size one-fourth said square shape and four times said thickness comprising:

first and second pairs of triangular segments, each said pair arranged with respective hypotenuses coextensively adjacent forming respective first and second square segments;

third and fourth square segments;

each of said first, second, third and fourth square segments being dimensionally identical and arranged as orthogonal quadrants forming said planar square shape, said first and second square segments disposed diagonally opposite each other with said hypotenuses aligned forming a continuous diagonal of said planar square shape; and hinge means joining respective contiguous edges of said first, second, third and fourth square segments and said respective hypotenuses.

2. The board defined in claim 1 wherein pivot axes of said hinge means joining said respective contiguous edges of said first, second, third and fourth square segments are substantially coplanar with a first surface of said board and pivot axes of said hinge means joining said respective hypotenuses are substantially coplanar with a second surface of said board.

3. The board defined in claim 2 wherein said hinge means comprises thin flexible strips affixed to respective surfaces of said board spanning respective contiguous edges and respective adjacent coextensive hypotenuses.

4. The board defined in claim 3 wherein said hinge means on said first surface comprises a thin sheet affixed to said first surface over substantially an entire area of said first surface said sheet being severed along said diagonal.

5. The board defined in claim 4 wherein said hinge means on said second surface comprise a second thin sheet affixed to said second surface over substantially an entire area of said second surface, said second thin sheet being severed along said respective contiguous edges of said square segments.

6. The board defined in claim 2 wherein at least one of said first and second surfaces comprises a graphic pattern defining a game to be played on said board.

7. The board defined in claim 2 wherein said thickness is less than one-fourth the length of a side of said first, second, third and fourth square segments and greater than approximately one-sixteenth the length of said first, second, third and fourth square segments, said board sustaining its unfolded planar shape when disposed with said first surface facing upward and supported on said second surface at opposite corners of said continuous diagonal.

8. The board defined in claim 1 wherein said thickness is less than one-fourth the length of a side of said first, second, third and fourth square segments.

9. A method of making a foldable square game board having first and second planar surfaces and a thickness less than one-eighth the length of a side thereof, at least one of said first and second planar surfaces defining a planar game-playing surface in an open condition of said board, and being foldable to a square storage condition having a size one-fourth said open condition and four times said thickness comprising:

forming first and second pairs of right triangular segments, each triangular segment having sides equal to one-half of a side of said board;

arranging said first and second pairs of right triangular segments into respective first and second square segments with respective hypotenuses coextensively adjacent;

forming third and fourth square segments having sides equal to one-half the length of said board;

arranging said first, second, third and fourth square segments as orthogonal quadrants, said first and second square segments being diagonally opposite each other with said hypotenuses aligned as a continuous diagonal of said board;

hinging respective contiguous edges of said square segments for pivoting along a first surface of said board; and hinging respective said coextensively adjacent hypotenuses for pivoting along a second surface of said board.

10. The method of making a foldable square game board defined in claim 9 wherein said hinging is accomplished by affixing a thin flexible strip to said segments at a first surface of said board at each of said respective contiguous edges, said strip spanning said respective contiguous edges, and affixing a thin flexible strip to said second surface of said board along and spanning said respective hypotenuses.

11. The method of making a foldable square game board defined in claim 9 wherein said hinging is accomplished by affixing a thin sheet to said first surface of said board over substantially the entire area thereof, affixing a thin flexible strip to said second surface of said board along and spanning said respective hypotenuses, and severing said sheet affixed to said first surface of said board along said hypotenuses.

12. The method of making a foldable square game board defined in claim 11 wherein at least one of said thin sheets is imprinted with a graphic pattern.

13. The method of making a foldable square game board defined in claim 9 wherein said hinging is accomplished by affixing thin sheets to said first and second surfaces of said board over substantially an entire respective area of said first and second surfaces, severing said thin sheet in said first surface along said hypotenuses, and severing said thin sheet on said second surface along respective said contiguous edges of said first, second, third and fourth square segments.

14. A foldable square game board having first and second planar surfaces and a thickness no greater than one-eighth the length of a side of said board, at least one of said first and second planar surfaces defining a planar game-playing surface, said board being foldable to a square storage condition having a size one-fourth the original square and four times its thickness, said board being scored on said first surface along two perpendicular lines each bisecting said surface defining a quadrilateral pattern and being scored on said second surface along a diagonal line extending between a pair of opposite corners.

15. The foldable square board defined in claim 14 wherein said scored lines extend substantially the entire thickness of said board.

16. The foldable square board defined in claim 15 wherein at least one of said first and second surfaces comprises a graphic pattern defining a game to be played on said board.

* * * * *